US008028548B2

(12) United States Patent
Woo et al.

(10) Patent No.: US 8,028,548 B2
(45) Date of Patent: Oct. 4, 2011

(54) LAUNDRY MACHINE WITH HEIGHT INCREASING MEMBER AND DRAINAGE FILTER SERVICING SECTION

(75) Inventors: Ki Chul Woo, Seoul (KR); Na Eun Kim, Seoul (KR); Dong Won Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 602 days.

(21) Appl. No.: 12/122,258

(22) Filed: May 16, 2008

(65) Prior Publication Data

US 2009/0007602 A1 Jan. 8, 2009

(30) Foreign Application Priority Data

May 17, 2007 (KR) ..... 10-2007-0048042
May 17, 2007 (KR) ..... 10-2007-0048043

(51) Int. Cl.

| | |
|---|---|
| ***D06F 39/10*** | (2006.01) |
| ***D06F 21/00*** | (2006.01) |
| ***D06F 23/00*** | (2006.01) |
| ***D06F 25/00*** | (2006.01) |
| ***D06F 37/00*** | (2006.01) |
| ***D06F 39/00*** | (2006.01) |

(52) U.S. Cl. ..... 68/12.13; 68/140; 68/208

(58) Field of Classification Search ..... 68/208, 68/12.13, 140

See application file for complete search history.

(56) References Cited

U.S. PATENT DOCUMENTS

| | | | |
|---|---|---|---|
| 4,002,199 | A | 1/1977 | Jacobs |
| 4,618,193 | A | 10/1986 | Cuthbert et al. |
| 5,368,379 | A | 11/1994 | Wrangberth |
| 5,829,767 | A | 11/1998 | Grossman |
| 5,947,197 | A | 9/1999 | Lee |
| 6,158,257 | A | 12/2000 | Ryan et al. |
| 6,618,887 | B2 | 9/2003 | Kim et al. |
| 6,732,552 | B2 | 5/2004 | Kim et al. |
| 7,748,682 | B2 | 7/2010 | Hunke et al. |
| 7,976,111 | B2 | 7/2011 | Sans Rovira et al. |
| 2002/0017117 | A1 | 2/2002 | Sunshine et al. |
| 2002/0056293 | A1 | 5/2002 | Kin et al. |
| 2002/0153816 | A1 | 10/2002 | Banicevic et al. |

(Continued)

FOREIGN PATENT DOCUMENTS

| | | |
|---|---|---|
| DE | 1 135 408 | 8/1962 |

(Continued)

OTHER PUBLICATIONS

PCT International Search Report and Written Opinion dated Aug. 5, 2010 issued in Application No. PCT/KR2008/0027252.

(Continued)

*Primary Examiner* — Michael Barr
*Assistant Examiner* — Charles W Kling
(74) *Attorney, Agent, or Firm* — KED & Associates LLP

(57) ABSTRACT

A laundry machine includes a height increasing member between a washing tub and an installation surface of a cabinet. The height increasing member includes a housing with an opening to support the washing tub in the cabinet, a body with a storage space that moves in and out of the opening in the housing, and a door panel to hide a servicing section when the body is moved into the opening and to expose the servicing section when the movable body is moved out from the opening. The servicing section may include or otherwise provide access to a filter.

9 Claims, 8 Drawing Sheets

U.S. PATENT DOCUMENTS

| | | | | |
|---|---|---|---|---|
| 2004/0134237 | A1 | 7/2004 | Sunshine et al. | |
| 2004/0226320 | A1 | 11/2004 | Bongini | |
| 2005/0150523 | A1 | 7/2005 | Schock | |
| 2005/0172678 | A1 | 8/2005 | Kim et al. | |
| 2005/0178165 | A1 * | 8/2005 | Carey et al. | 68/12.05 |
| 2006/0103281 | A1 | 5/2006 | Cho | |
| 2006/0112737 | A1 | 6/2006 | Sunshine et al. | |
| 2006/0130518 | A1 | 6/2006 | Kang | |
| 2006/0130535 | A1 | 6/2006 | Sunshine et al. | |
| 2006/0156765 | A1 | 7/2006 | Sunshine et al. | |
| 2007/0075614 | A1 | 4/2007 | Calmeise | |
| 2007/0249212 | A1 | 10/2007 | Buecker et al. | |
| 2009/0146536 | A1 | 6/2009 | Kim et al. | |

FOREIGN PATENT DOCUMENTS

| | | | |
|---|---|---|---|
| DE | 2034848 | | 1/1972 |
| DE | 27 03 215 | A1 | 8/1978 |
| DE | 298 11 701 | U1 | 11/1999 |
| DE | 29811701 | U1 * | 11/1999 |
| DE | 198 38 631 | A1 | 3/2000 |
| DE | 19956973 | | 8/2000 |
| DE | 203 02 572 | | 5/2003 |
| DE | 10 2005 053 554 | | 10/2006 |
| EP | 1 108 810 | | 6/2001 |
| EP | 1 233 100 | | 8/2002 |
| EP | 1 233 100 | A1 | 8/2002 |
| EP | 1233100 | A1 * | 8/2002 |
| EP | 1 491 676 | | 12/2004 |
| EP | 1 528 141 | | 5/2005 |
| EP | 1 577 434 | | 9/2005 |
| EP | 1 577 434 | A2 | 9/2005 |
| EP | 1 726 703 | | 11/2006 |
| JP | 04-184077 | | 7/1992 |
| JP | 2001-116421 | | 4/2001 |
| JP | 2005-172298 | | 6/2005 |
| JP | 2007-212053 | | 8/2007 |
| WO | WO 2004/055254 | | 7/2004 |
| WO | WO 2004055254 | A1 * | 7/2004 |

OTHER PUBLICATIONS

International Search Report and the Written Opinion of the International Searching Authority issued in PCT/KR2008/005686 dated Mar. 22, 2010.

European Search Report dated Apr. 1, 2010. (Application No. 09015496.4-2314).

International Search Report and Written Opinion issued in Application No. PCT/KR2008/0027252 dated Aug. 5, 2010.

International Search Report and Written Opinion issued in PCT/KR 2008/002751 dated Aug. 16, 2010.

International Search Report dated Nov. 3, 2010 (Application No. PCT/KR2008/002725).

U.S. Office Action issued in U.S. Appl. No. 12/122,245 dated Feb. 23, 2011.

European Search Report dated May 23, 2011.

U.S. Office Action dated Jun. 30 2011 for related U.S. Appl. No. 12/122,245.

U.S. Office Action dated Jul. 20, 2011 for related U.S. Appl. No. 12/122,044.

* cited by examiner

LAUNDRY MACHINE WITH HEIGHT INCREASING MEMBER AND DRAINAGE FILTER SERVICING SECTION

This application claims the benefit of Korean Patent Application No. 10-2007-0048042, filed on May 17, 2007, Korean Patent Application No. 10-2007-0048043, filed on May 17, 2007, which are hereby incorporated by reference as if fully set forth herein.

BACKGROUND OF THE INVENTION

1. Field of the Invention

The present invention relates to a laundry machine capable of washing or drying laundry.

2. Discussion of the Related Art

A washing machine is known as a home appliance for washing laundry, etc, and a drying machine is known as a home appliance for drying wet laundry. Recently, a home appliance having a combined function of a washing machine and a drying machine has been widely used. Hereinafter, a washing machine, a drying machine, and a home appliance having a combined function thereof will be generically referred to as a laundry machine, for convenience of description.

Generally, such laundry machines are classified into a top loading type and a front loading type in accordance with the laundry loading position. Also, laundry machines are classified into a vertical-axis type, in which a drum or a pulsator rotates, and a horizontal-axis type, in which a drum extending horizontally rotates. The representative example of such a horizontal-axis type laundry machine is a drum washing machine or a drum drying machine.

Typically, a conventional laundry machine is directly installed on a floor. In this connection, in the case of a front loading type laundry machine, it is inconvenient for the user to load and unload laundry because the position of the loading/unloading opening of the laundry machine is low. For this reason, it is necessary to increase the level of the opening of the laundry machine.

In this regard, as shown in FIG. 1, a height increasing member 2 may be installed beneath a laundry machine 1, for user convenience.

However, where the laundry machine 1 is placed upon the height increasing member 2, as mentioned above, there is a problem in that the appearance of the laundry machine 1 is spoiled.

Furthermore, the height increasing member 2 must have a sufficient strength to support the overall weight of the laundry machine 1. This may result in an increase in the manufacturing costs and weight of the height increasing member 2.

In addition, where the laundry machine 1 is placed upon the height increasing member 2, the generation of vibration at the laundry machine 1 increases, as compared to the case in which the height increasing member 2 is not used.

Meanwhile, in the conventional laundry machine 1, a drainage filter 6 is arranged at a lower portion of the laundry machine 1, to filter out foreign matter such as lint, etc. contained in drained wash water.

The drainage filter 6 is separably mounted, in order to allow the user to clean the drainage filter 6 when an excessive amount of foreign matter is accumulated on the drainage filter 6. The drainage filter 6 is mounted in the lower portion of the laundry machine 1. A low cover cap 4 is mounted to the cabinet such that the low cover cap 4 is openable/closable, to allow the user to separate the drainage filter 6 from the cabinet or to again mount the drainage filter 6 in the cabinet in an opened state of the low cover cap 4.

In the above-mentioned conventional laundry machine, however, there is a problem in that the appearance of the laundry machine is spoiled because the low cover cap 4 is arranged at the front side of the laundry machine.

Furthermore, since the height increasing member 2 is installed on the floor, there is inconvenience in that the user must stoop to open the drawer of the height increasing member 2.

SUMMARY OF THE INVENTION

Accordingly, the present invention is directed to a laundry machine that substantially obviates one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine comprises: a washing tub arranged in a cabinet, to receive laundry; a movable body installed between the washing tub and an installation surface of the cabinet, the movable body being outwardly movable from the cabinet; and a servicing section provided at a position that is outwardly exposed in an outwardly-moved state of the movable body, and is hidden in an inwardly-moved state of the movable body, for maintenance of a drainage filter.

The servicing section may comprise a hole formed to enable the maintenance of the drainage filter. The drainage filter may be separably mounted in the hole of the servicing section.

The cabinet may include an opening, through which the movable body is outwardly movable from the cabinet. The servicing section may be arranged in the vicinity of the opening.

The servicing section may be arranged over the opening or at one side of the opening.

The movable body may be defined with a space for storing articles.

The movable body may open and close up to a portion of the cabinet arranged at a level higher than the opening of the cabinet. The movable body may include a handle provided at an upper portion of the movable body, to allow a user to grasp the handle by a hand.

In accordance with another aspect of the present invention, a laundry machine comprises: a washing tub arranged in a cabinet, to receive laundry; a movable body installed between the washing tub and an installation surface of the cabinet, the movable body being outwardly movable from the cabinet; and a drainage filter separably installed at a position that is outwardly exposed in an outwardly-moved state of the movable body, and is hidden in an inwardly-moved state of the movable body.

The cabinet may include an opening, through which the movable body is outwardly movable from the cabinet. The drainage filter may be arranged in the vicinity of the opening.

The drainage filter may be arranged over the opening or at one side of the opening.

The movable body may open and close up to a portion of the cabinet arranged at a level higher than the opening of the cabinet. The movable body may include a handle provided at an upper portion of the movable body, to allow a user to grasp the handle by a hand.

In accordance with another aspect of the present invention, a laundry machine comprises: a washing tub arranged in a cabinet, to receive laundry; a housing arranged to secure a space between the washing tub and an installation surface of the cabinet, the housing is opened through at least one side of the housing, to form an opening; a movable body installed to be received in the housing, the movable body being outwardly movable from the cabinet through the opening of the housing; and a servicing section provided at a position that is outwardly exposed in an outwardly-moved state of the movable body, and is hidden in an inwardly-moved state of the movable body, for maintenance of a drainage filter.

The servicing section may comprise a hole formed to enable the maintenance of the drainage filter. The drainage filter may be separably mounted in the hole of the servicing section.

The drainage filter may be arranged in the vicinity of the opening of the housing.

The housing may comprise a lower base forming a bottom wall of the cabinet, and an upper base arranged over the lower base, to partition the space, where the movable body is received, from the washing tub.

The movable body may open and close up to a portion of the cabinet arranged at a level higher than the opening of the housing.

The movable body may include a handle provided at an upper portion of the movable body, to allow a user to grasp the handle by a hand.

In accordance with the laundry machine of the present invention, the following effects are provided.

First, the appearance of the laundry machine is enhanced because the upper base, which has a height increasing function to increase the level of the opening of the laundry machine, and thus to enhance user convenience, is arranged in the cabinet. In particular, where the laundry machine is built in kitchen furniture such as a kitchen sink or a kitchen table, it is possible not only to provide a beautiful appearance, but also to achieve user convenience.

Second, it is possible to considerably reduce the generation of vibration during an operation of the laundry machine because the upper base functioning as a height increasing member is integrated with the cabinet, so that the rigidity can be enhanced, as compared to the conventional case in which the laundry machine is simply placed upon the height increasing member.

Third, it is possible to efficiency use the space because a space capable of storing articles is defined in the movable body.

Fourth, it is possible to simplify the manufacturing process in that it is unnecessary to separately prepare a constituent element corresponding to a conventional low cover cap because the drainage filter is exposed or hidden in accordance with an opening or closing operation of the movable body. Accordingly, it is possible to achieve an enhancement in productivity, and to provide a beautiful appearance of the product.

Fifth, there is an enhanced convenience in that it is unnecessary for the user to bend down too far upon outwardly moving the movable body because the movable body or a door panel extends upwardly to an increased level, and the handle is provided at the increased level.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Wherever possible, the same reference numbers will be used throughout the drawings to refer to the same or like parts as known configurations incorporated herein, and no detailed description thereof will be given.

Figure 2:
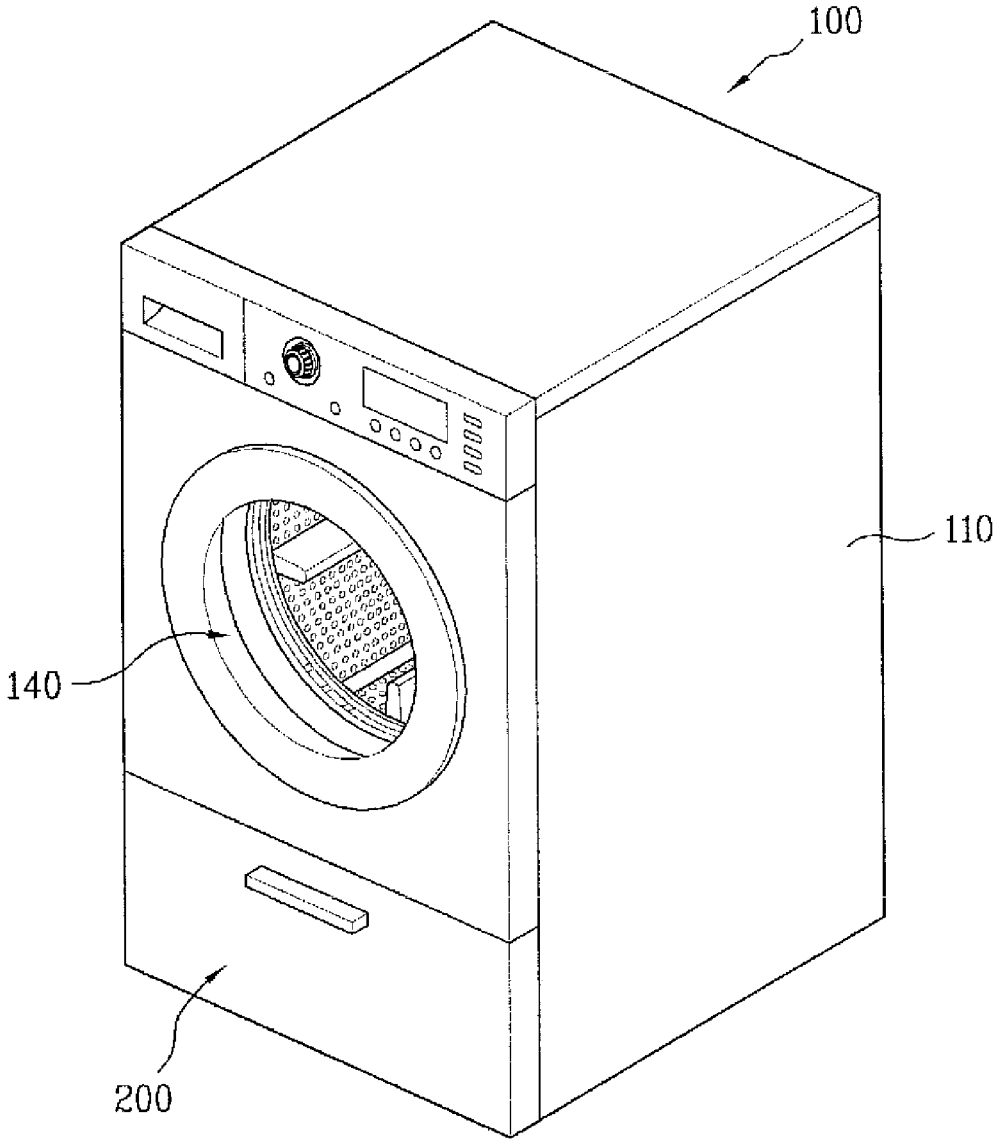
FIG. 2 is a perspective view illustrating a laundry machine according to an exemplary embodiment of the present invention.
Figure 3:
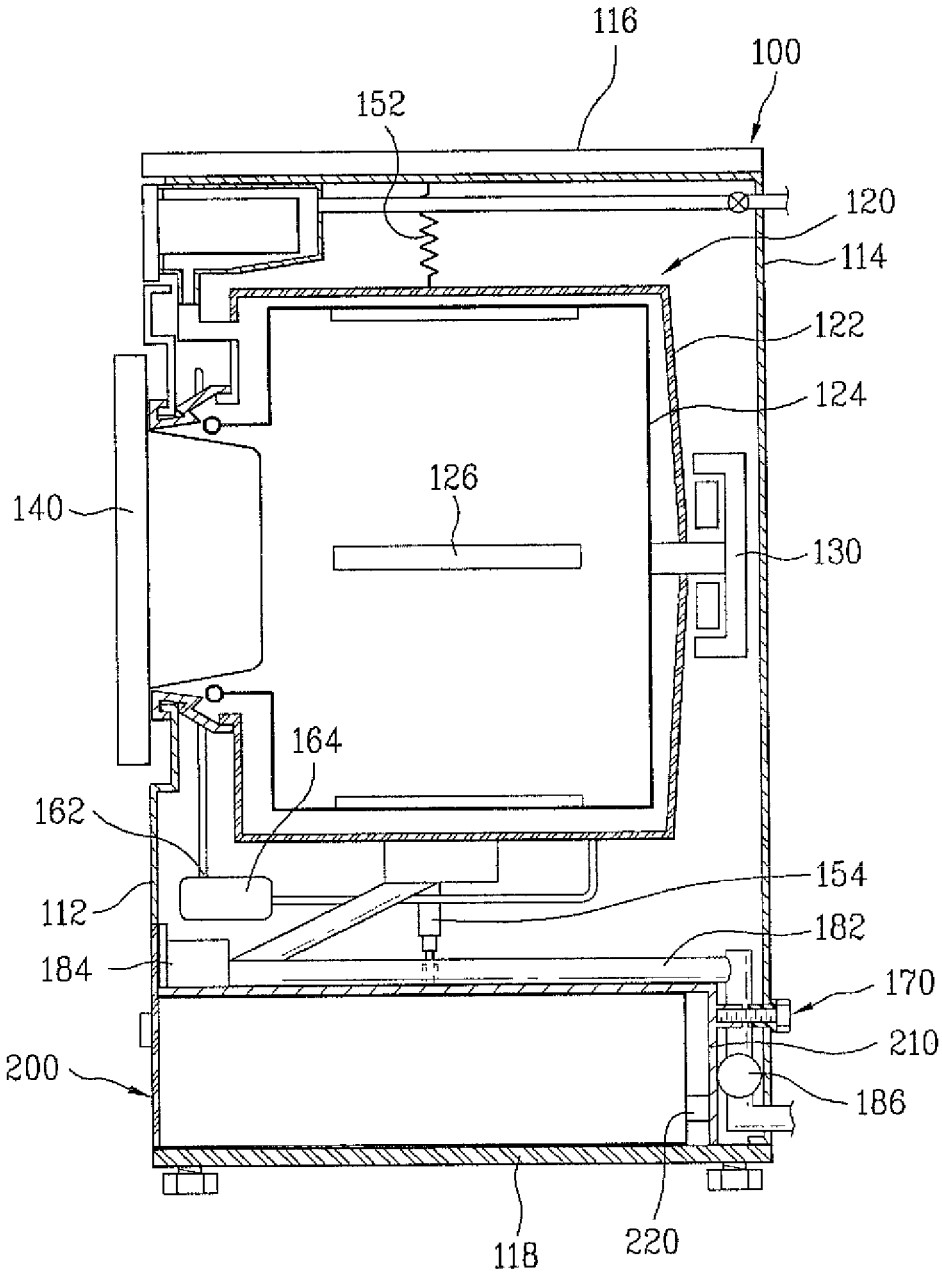
FIG. 3 is a sectional view of the laundry machine shown in FIG. 2.

Referring to FIGS. 2 and 3, a laundry machine 1 according to the present invention is illustrated. The laundry machine 1 includes a cabinet 110 forming an outer appearance of the laundry machine 1, and a washing tub 120 arranged in the cabinet 110.

The cabinet 110 includes a front cover 112 forming a front wall of the cabinet 110, side plates forming side walls of the cabinet 110, a rear cover 114 forming a rear wall of the cabinet 110, and a top plate 116 forming a top wall of the cabinet 110.

A door 140 is mounted to the front cover 112 of the cabinet 110. A control panel is arranged on an upper portion of the front wall of the cabinet 110, to enable the user to operate the laundry machine 1.

The washing tub 120 may include a tub 122 for storing wash water, and a drum 123 rotatably arranged in the tub 122.

The tub 122 and drum 124 are provided with openings, respectively, so that they communicate with the outside thereof when the door 140 is opened, to enable loading/unloading of laundry. The drum 124 is rotated by a motor 130. A plurality of lifts 126 are arranged on an inner surface of the drum 124. Accordingly, a washing operation is carried out in such a manner that the lifts 126 raise laundry received in the drum 124, and then let the raised laundry fall, during the rotation of the drum 124.

Water from an external water supply source is supplied to the tub 122 via a water supply hose, so that the supplied water is stored in the tub 122. The water stored in the tub 122 is outwardly discharged via a water discharge hose 182. A circulation hose 162 is also connected to the tub 122. A circulation pump 164 is arranged at an intermediate portion of the circulation hose 162. When the circulation pump 164 operates, the water stored in the tub 122 is discharged, and then is again sprayed into the tub 122 via the circulation hose 162. As the water from the tub 122 is pumped, and is then again sprayed into the tub 122, a variety of water flows are generated in the drum 124, and an impact force and a frictional force are generated in accordance with the spray of water. Thus, a washing effect and a rinsing effect are enhanced.

Meanwhile, where the door 140 of the laundry machine 1 is provided at the front side of the cabinet 110, the user must bend down upon loading laundry into the washing tub 120 or unloading the laundry from the washing tub 120. In order to prevent the user from having to bend down too far, accordingly, it is necessary to install the washing tub 120 at an increased level.

Figure 4:
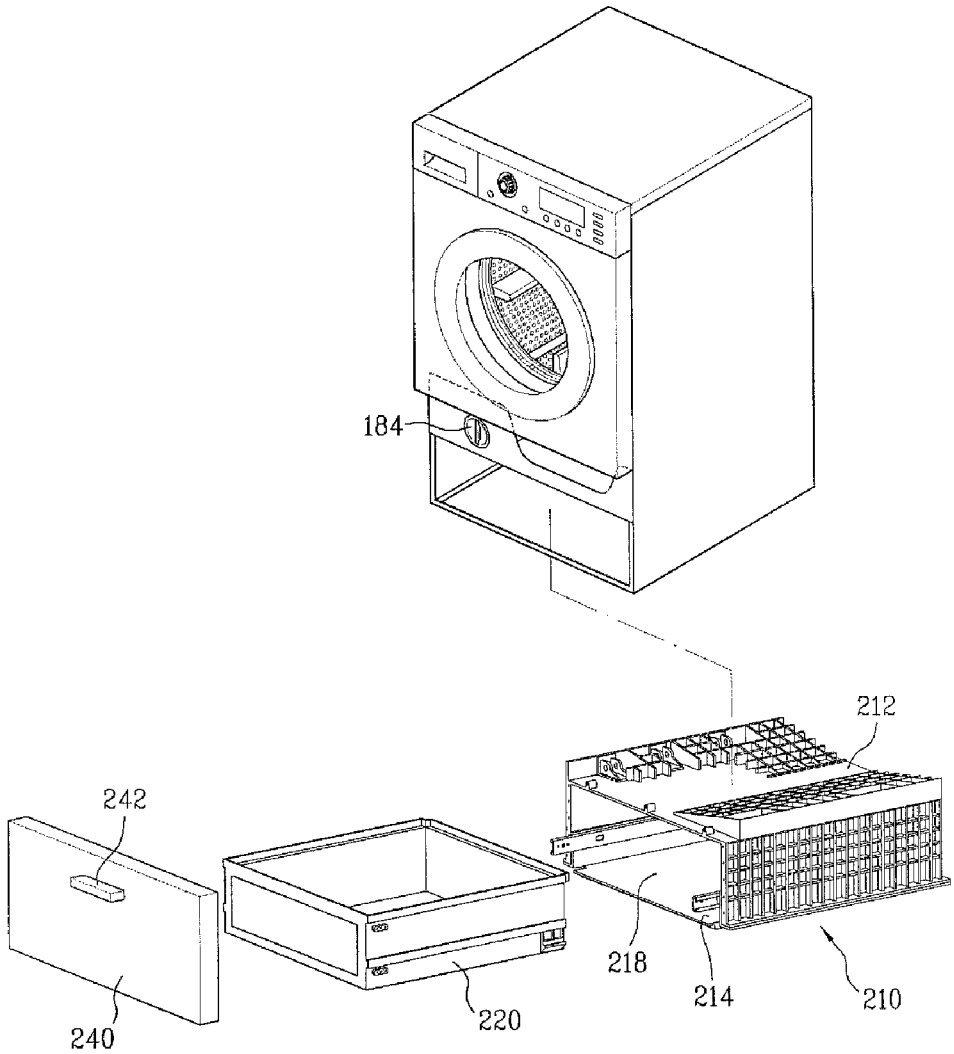
FIG. 4 is an exploded perspective view of the laundry machine shown in FIG. 2.

To this end, in the laundry machine 1 of the present invention, the washing tub 120 is vertically spaced apart from the installation surface of the laundry machine 1, to define a certain space to increase the levels of the door 140 and washing tub 120, and thus to enable the user to easily load/unload laundry, as shown in FIG. 4. In this case, the space is defined by a housing 210 arranged between the washing tub 120 and the installation surface of the laundry machine 1.

That is, the housing 210 corresponds to a height increasing member 200 securing a certain space between the washing tub 120 and the installation surface of the laundry machine 1, in order to increase the levels of the door 140 and washing tub 120.

Preferably, the housing 210 has an opening 218 formed through at least one side wall of the housing 210. Although it is preferred that the opening 218 be formed at the front side of the laundry machine 1, the present invention is not limited thereto. The opening 218 may be formed at one lateral side or rear side of the laundry machine 1.

A movable body 220 is arranged in the housing 210 such that the movable body 220 is outwardly movable from the cabinet 110 through the opening 219 of the housing 210.

The movable body 220 may be defined therein with a space for storing articles.

As the movable body 220, in which a space for storing articles is defined, is arranged in the internal space of the height-increasing housing 210 such that the movable body 220 is outwardly and inwardly movable through the housing 210, similar to a drawer, it is possible to efficiently use the space of the laundry machine 1.

Of course, the movable body 220 is not always required to have a structure similar to the drawer. The movable body 220 may take the form of a small-size home appliance such as a washing or drying machine having a small capacity.

Preferably, the bottom wall of the housing 210 forms the bottom wall 118 of the cabinet 110. That is, the housing 210 is arranged in the cabinet 110 such that the bottom wall of the housing 210 forms the bottom wall 118 of the cabinet 110.

Of course, the housing 210 may be arranged in the cabinet 110 such that the bottom wall of the housing 210 is separate from the bottom wall 118 of the cabinet 110.

In accordance with this embodiment, the housing 210 includes an upper base 212 for partitioning the space, in which the movable body 220 is arranged, from the space, in which the washing tub 120 is arranged, and a lower base 214 coupled to a lower end of the upper base 212, to define a space between the upper base 212 and the lower base 214, and to form the lower wall of the housing 210.

The upper base 212 forms the top wall, side walls, and rear wall of the housing 210. The lower base 214 may have a substantially plate-shaped structure.

A damper 154, etc. for supporting the washing tub 120 may be coupled to the top wall of the upper base 212. A plurality of ribs may also be formed at the upper base 212, to reinforce the upper base 212, and thus to stably support the damper 154. The damper 154 may be coupled to a portion of the upper base 212 reinforced by the ribs.

Similar to the above-described case, the lower base 214 forms both the bottom wall of the housing 210 and the bottom wall of the cabinet 110.

Figure 1:
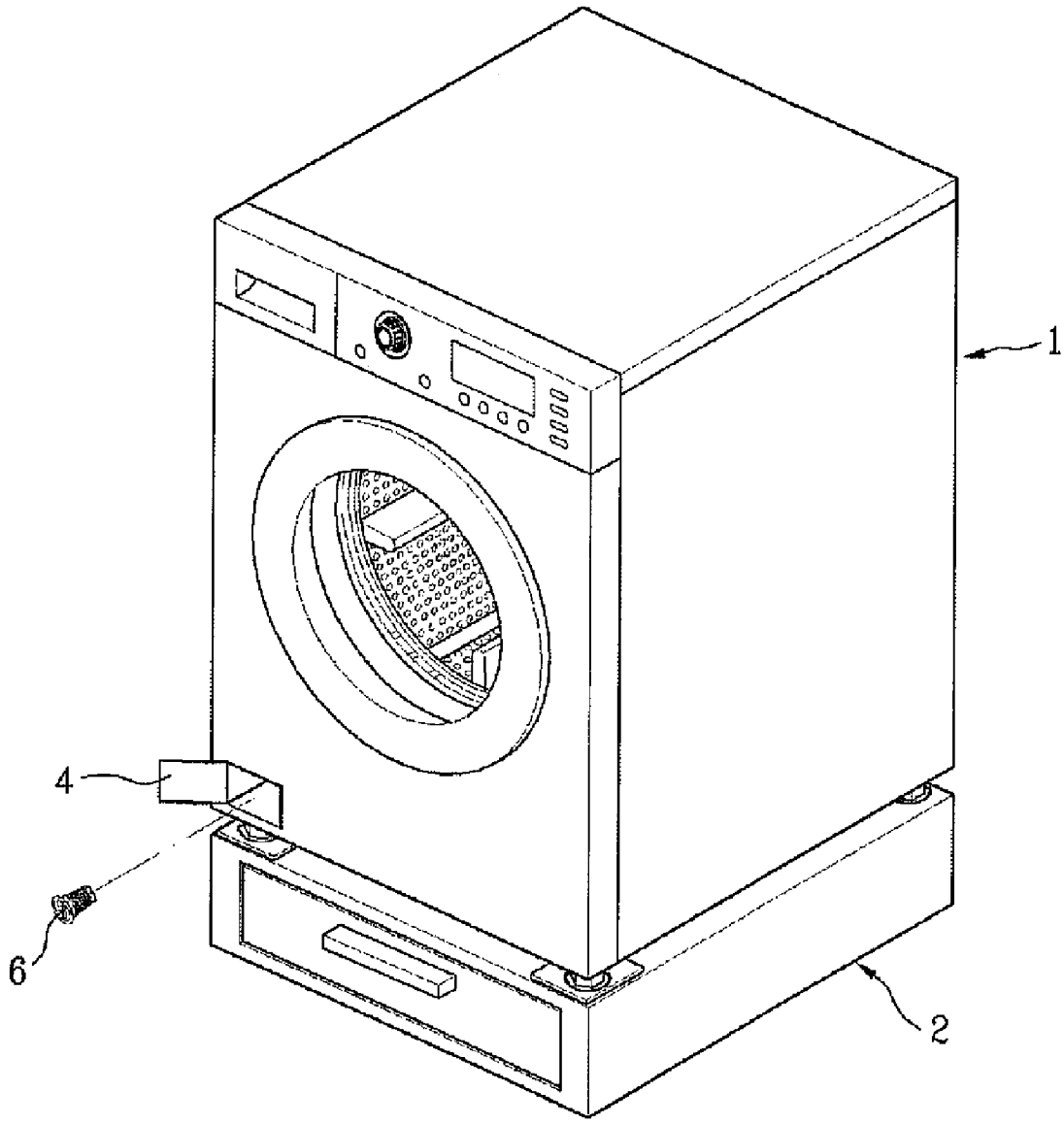
FIG. 1 is a perspective view illustrating a conventional laundry machine.

In the present invention, the housing 210, which functions as the height increasing member 200, supports only the weights of the washing tub 120 and elements mounted to the washing tub 120, different from the conventional height increasing member 2 (FIG. 1) that supports the overall weight of the laundry machine 1. That is, the housing 210 does not support the weights of the cabinet 110 and elements mounted to the cabinet 110.

Since the housing 210 supports a reduced weight, as compared to the conventional height increasing member 2, and the bottom wall of the housing 210 forms the bottom wall of the cabinet 110, it is possible to achieve a reduction in the number of elements used, a reduction in manufacturing costs, and a reduction in the number of manufacturing processes used, as compared to the conventional case. Accordingly, an enhancement in productivity and a reduction in weight can be achieved.

Figure 5:
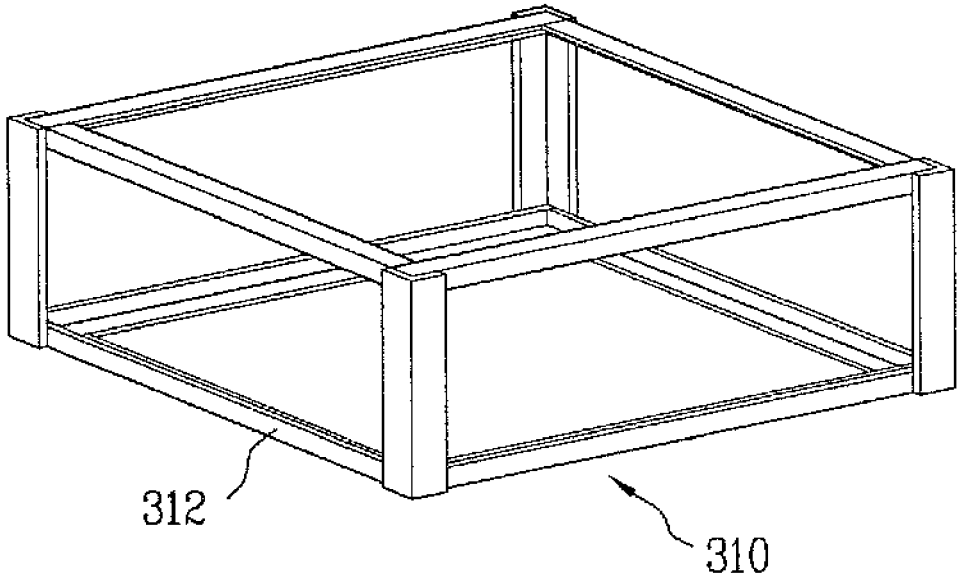
FIG. 5 is a perspective view illustrating another embodiment of a housing shown in FIG. 4.

The housing 210 may have a structure different from the above-described structure in which the housing 210 includes the upper and lower bases 212 and 214. For example, as shown in FIG. 5, a frame structure 310 may be implemented. The frame structure 310 includes bar-shaped members 312 coupled together to form a space between the washing tub and the machine installation surface, in order to receive the movable body 220 while increasing the installation level of the washing tub.

Of course, it is preferred that the damper, etc. for supporting the washing tub be directly coupled to the frame 310.

Figure 6:
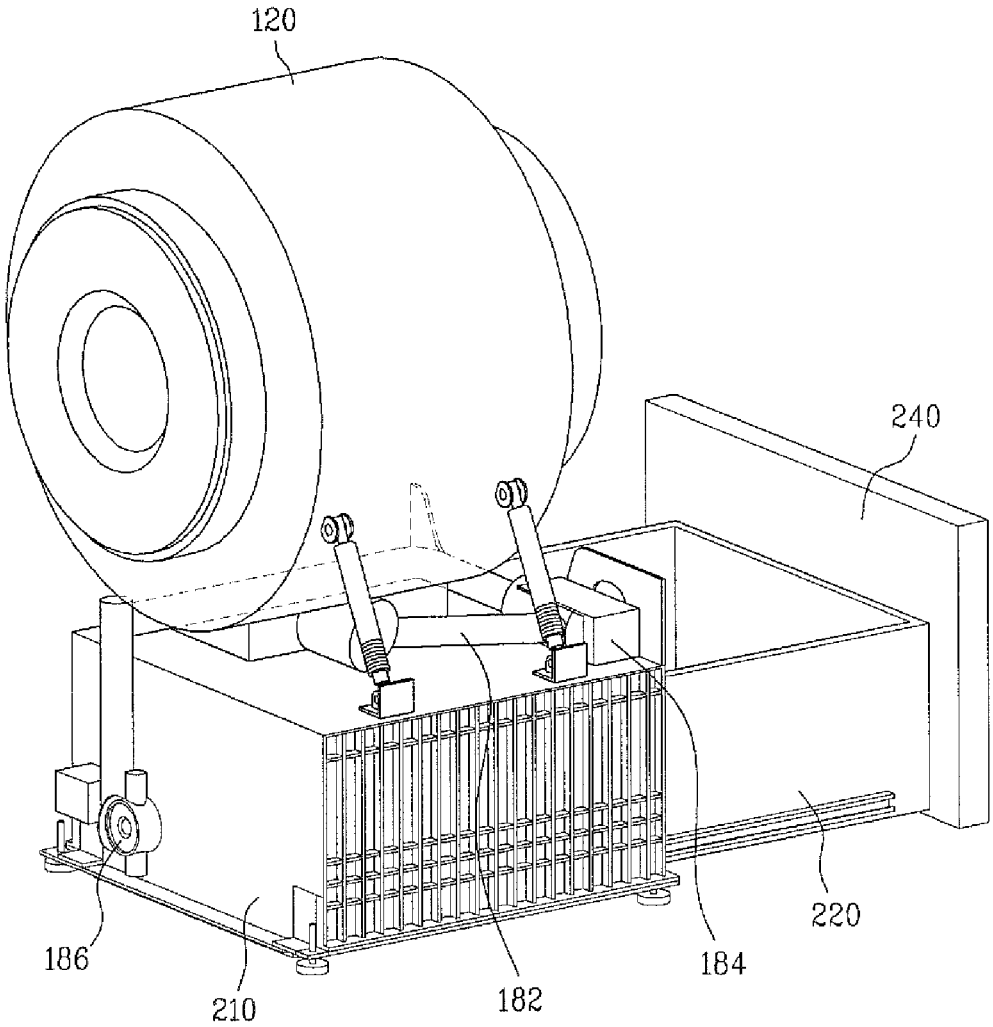
FIG. 6 is a rear perspective view illustrating a part of the inner configuration of a laundry machine according to an exemplary embodiment of the present invention.

Meanwhile, as shown in FIG. 6, the laundry machine 1 also includes a drainage line 182 for draining wash water from the washing tub 120 during a washing operation, and a drainage pump 186 for forcibly draining the wash water.

Preferably, the drainage pump 186 is arranged at a level lower than the washing tub 120, in order to utilize a water head difference. More preferably, the drainage pump 186 is arranged in a space defined between the rear wall of the housing 210 and the rear wall 114 of the cabinet 110.

In order to prevent the drainage pump 186 from being clogged by foreign matter such as lint contained in the wash water, a drainage filter 184 is also provided to filter out foreign matter from the wash water before the wash water is introduced into the drainage pump 186.

The laundry machine 1 according to the present invention further includes a servicing section arranged at a position that is outwardly exposed in an outwardly-moved state of the movable body 220, and is hidden in an inwardly-moved state of the movable body 220, for the maintenance of the drainage filter 184.

The servicing section means a section provided in the laundry machine 1 to allow the user to access the drainage filter 184, for the maintenance of the drainage filter 184. The servicing section may include a hole formed to allow the user to access the drainage filter 184, for the maintenance of the drainage filter 184.

It is preferred that the drainage filter 184 be separably installed at a position that is outwardly exposed when the movable body 220 is outwardly moved from the housing 210, and is hidden when the movable body 220 is inwardly moved into the housing 210. That is, the drainage filter 184 is separably mounted in the hole of the servicing section. The servicing section may be arranged such that it is outwardly exposed when the movable body 220 is outwardly moved from the housing 210. In this regard, it is preferred that the servicing section be arranged in the vicinity of the opening 218.

Since the movable body 220 is installed such that it is outwardly movable through the front side of the cabinet 110, it is also preferred that the drainage filter 184 be installed at the front side of the cabinet 110.

The drainage filter 184 may be installed at the opening 218 of the housing 210. In this case, however, the drainage filter 184 may interfere with the outward and inward movements of the movable body 220. Furthermore, the drainage filter 184 may interfere with the articles stored in the interior of the movable body 220.

To this end, in this embodiment, the drainage filter 184 is proposed to be arranged over the opening 218 of the housing 210, as shown in FIGS. 3 and 4. That is, the service section is arranged over the opening 218.

When the drainage filter 184 is arranged over the opening 218 of the housing 210, there is no possibility of the drainage filter 184 interfering with the movement of the movable body 220. Also, there is no possibility of the drainage filter 184 interfering with the articles stored in the interior of the movable body 220.

Since the drainage filter 184 is arranged over the opened portion of the housing 210 in the above-described case, it is also preferred that the portion of the movable body 220 corresponding to the opening 218 of the housing 210 extend upwardly beyond the opening 218 of the housing 210, in order to expose or hide the installation position of the drainage filter 184 in accordance with the outward or inward movement of the movable body 220.

Figure 7:
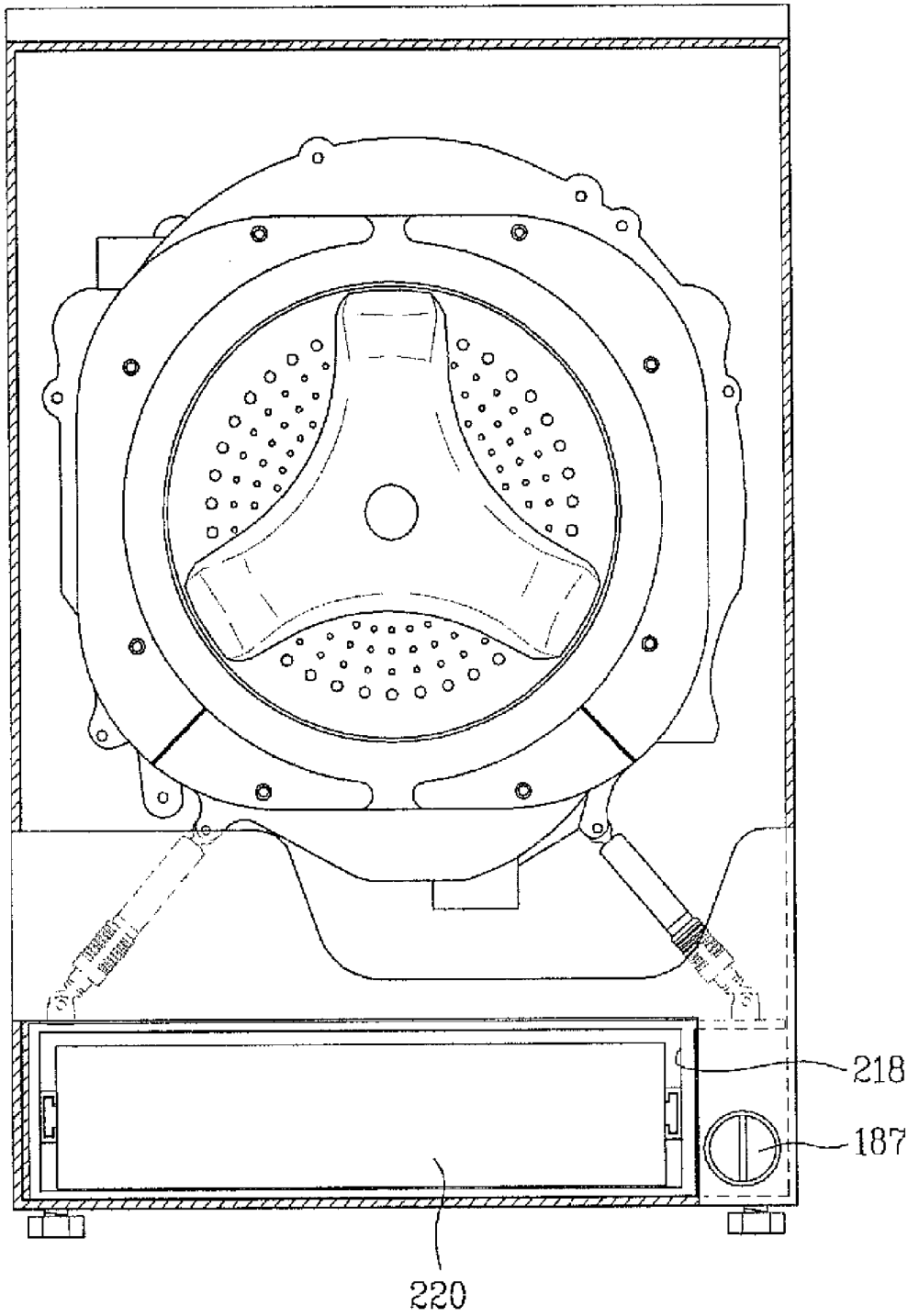
FIG. 7 is a front view illustrating a part of the inner configuration of a laundry machine according to another embodiment of the present invention.
Figure 8:
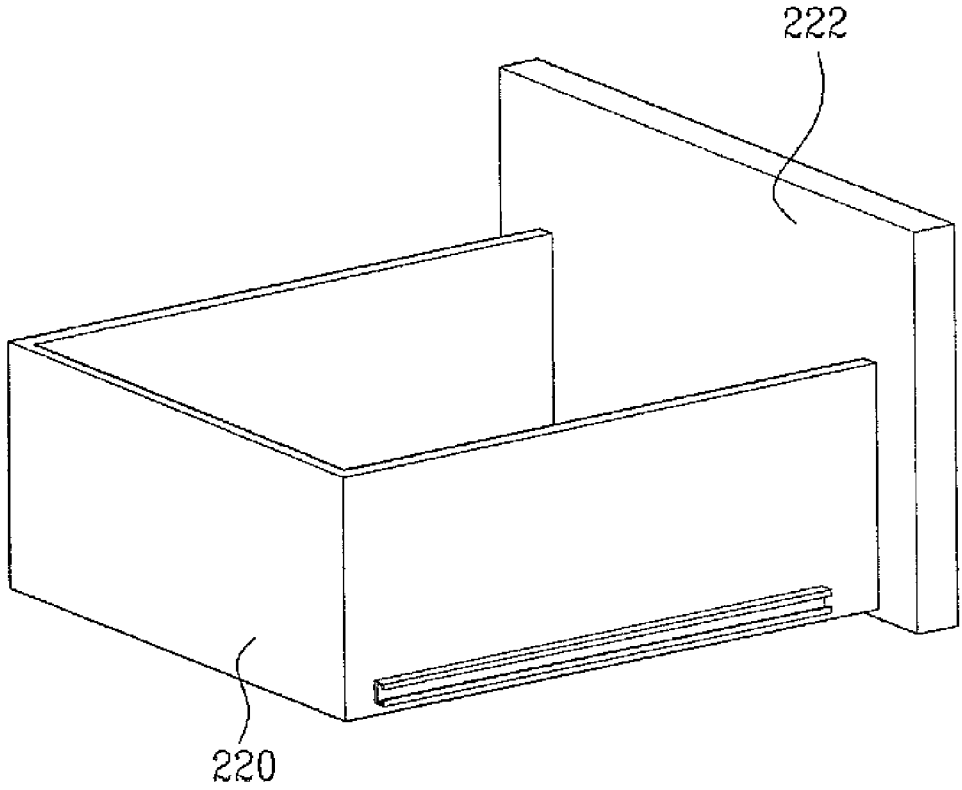
FIG. 8 is a perspective view illustrating another embodiment of a movable body shown in FIG. 4.

Of course, the present invention is not limited to the arrangement in which the drainage filter 184 is installed over the opening 218 of the housing 210. As shown in FIG. 7, a drainage filter 187 may be arranged at one side of the opening 218 of the housing 210. That is, the servicing section may be arranged at one side of the opening 218.

In this case, it is unnecessary for the portion of the movable body 220 corresponding to the opening 218 of the housing 210 to extend upwardly beyond the opening 218.

Since a surface (designated by reference numeral "240") of the movable body 220 corresponding to the opening 218 of the housing 210 exposes or hides the installation position of the drainage filter 184 in this case, it is unnecessary to install, at the outer surface of the cabinet 110, a separate constituent element corresponding to the conventional low cover cap 4. Accordingly, it is possible to simplify the manufacturing process, and thus to achieve an enhancement in productivity. Also, a beautiful appearance can be provided because it is unnecessary to install the separate low cover cap 4 at the front side of the cabinet 110.

When the movable body 220 is opened, for the cleaning of the drainage filter 184, the drainage filter 184 is exposed. Also, the opening operation of the movable body 220 can be easily carried out in a sliding manner. Accordingly, the convenience of use is enhanced.

Meanwhile, since the movable body 220 is arranged at the lower portion of the laundry machine 1, the user may be inconvenienced by having to bend down upon outwardly moving the movable body 220.

To this end, it is preferred that a handle 242 for enabling the user to outwardly move the movable body 220 be installed at a position as high as possible, in order to enable the user to more conveniently perform the outward movement of the movable body 220.

In order to install the handle 242 at a position as high as possible, as described above, the laundry machine 1 may further include a door panel 240 coupled to the front wall of the moveable body 220 such that the door panel 240 can slide along with the movable body 220, to open or close the opening 218 of the housing 210.

It is preferred that the door panel 240 extend upwardly beyond the opening 218 of the housing 210. It is also preferred that the handle 242 be installed at an uppermost portion of the door panel 240.

Of course, it is preferred that the door panel 240 be configured to expose or hide a region where the drainage filter 184 is installed, in accordance with the movement of the movable body 220.

In place of the door panel 240, which is a constituent element separate from the movable body 220, a wall 222 corresponding to the opening 218 of the housing 210, which is selected from the walls of the movable body 220, may extend upwardly beyond the opening 218 of the housing 210.

Of course, in this case, a handle (not shown) may be provided at an upper end of the extended wall 222, as in the previous embodiment. In this case, it is also preferred that the extended wall 222 be configured to expose or hide the region where the drainage filter 184 is installed, in accordance with the movement of the movable body 220.

Since the door panel 240 or the front wall 222 of the movable body 220 extends upwardly to an increased level, and the handle 242 is arranged at the increased level, it is unnecessary for the user to bend over deeply when outwardly moving the movable body 220. Accordingly, an enhanced convenience is provided.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a washing tub arranged in a cabinet, to receive laundry;

a height increasing member installed between the washing tub and an installation surface of the cabinet; and a servicing section provided in the cabinet adjacent to the height increasing member for maintenance of a drainage filter;

wherein the height increasing member includes:

a housing to support the washing tub in the cabinet and including an opening, a movable body including a storage space, the movable body moving in and out of the opening in the housing, and a door panel, coupled to a front side of the movable body, to hide the servicing section when the movable body is moved into the opening in the housing and to expose the servicing section when the movable body is moved out from the opening in the housing;

and wherein the height increasing member bears a weight of the washing tub and contents of the washing tub, without bearing a weight of the cabinet.

2. The laundry machine according to claim 1, wherein the servicing section comprises a hole formed to enable the maintenance of a drainage filter.

3. The laundry machine according to claim 2, wherein the drainage filter is separably mounted in a hole of the servicing section.

4. The laundry machine according to claim 1, wherein the servicing section is arranged over an opening which leads to a drainage filter.

5. The laundry machine according to claim 1, wherein the servicing section is arranged at one side of the opening in the housing.

6. The laundry machine according to claim 1, wherein the door panel overlaps a portion of the cabinet arranged at a level higher than the opening in the housing, and wherein an upper portion of the door panel overlaps the servicing section.

7. The laundry machine according to claim 6, wherein the movable body includes a handle to allow a user to move the movable body in and out of the opening in the housing.

8. The laundry machine according to claim 1, further comprising:

at least one support between the washing tub and a surface of the height increasing member, wherein the at least one support transfers weight of the washing tub to the height increasing member without transferring the weight of the cabinet to the height increasing member.

9. The laundry machine according to claim 1, wherein a bottom surface of the height increasing member forms a bottom surface of the laundry machine.

* * * * *